US005176397A

United States Patent [19]

Bogner et al.

[11] Patent Number: 5,176,397

[45] Date of Patent: Jan. 5, 1993

[54] HEEL UNIT FOR A SKI-BINDING

[75] Inventors: Martin Bogner, Ostfildern; Otto Harsányi, Leonberg, both of Fed. Rep. of Germany

[73] Assignee: GEZE Sport International GmbH, Leonberg, Fed. Rep. of Germany

[21] Appl. No.: 736,296

[22] Filed: Jul. 29, 1991

[30] Foreign Application Priority Data

Aug. 8, 1990 [DE] Fed. Rep. of Germany ..... 4025153

[51] Int. Cl.[5] ..... A63C 9/10

[52] U.S. Cl. ..... 280/632; 280/631; 280/634

[58] Field of Search ..... 280/632, 623, 626, 630, 280/631, 633, 634

[56] References Cited

U.S. PATENT DOCUMENTS 3,733,082 5/1973 Murata et al. ..... 280/632
4,758,017 7/1988 Stritzl et al. ..... 280/626

FOREIGN PATENT DOCUMENTS 1803997 9/1970 Fed. Rep. of Germany ..... 280/626
3122259 5/1982 Fed. Rep. of Germany ..... 280/631
3826410 2/1990 Fed. Rep. of Germany .

*Primary Examiner*—Eric D. Culbreth
*Attorney, Agent, or Firm*—Townsend and Townsend

[57] ABSTRACT

A heel unit of a ski binding has a housing (12) which is resiliently rearwardly deflectably mounted on the ski. A sole clamp (13) having a hold-down member (13') and a pedal element (13''), and also a hand-opening lever (15) are pivotably mounted about a transverse axis (14) in each case. The sole clamp (13) is biased by a release spring (16) into a closed position via a transmission (17, 18) having a deadpoint (26'). The sole clamp (13) can snap into an open position under the action of excessive vertical forces by moving through the deadpoint (26). The sole clamp (13) and the hand-opening lever (15) are pivotally mounted about the same transverse axis (14) which is arranged in the front region of the housing (12). Actuating abutments (19, 20) which cooperate with one another are provided at a radial distance from the transverse axis (14) and an opening moment is transmitted from the hand-opening lever (15) onto the sole clamp (13) via these actuating abutments.

7 Claims, 4 Drawing Sheets

HEEL UNIT FOR A SKI-BINDING

DESCRIPTION

Figure 1:
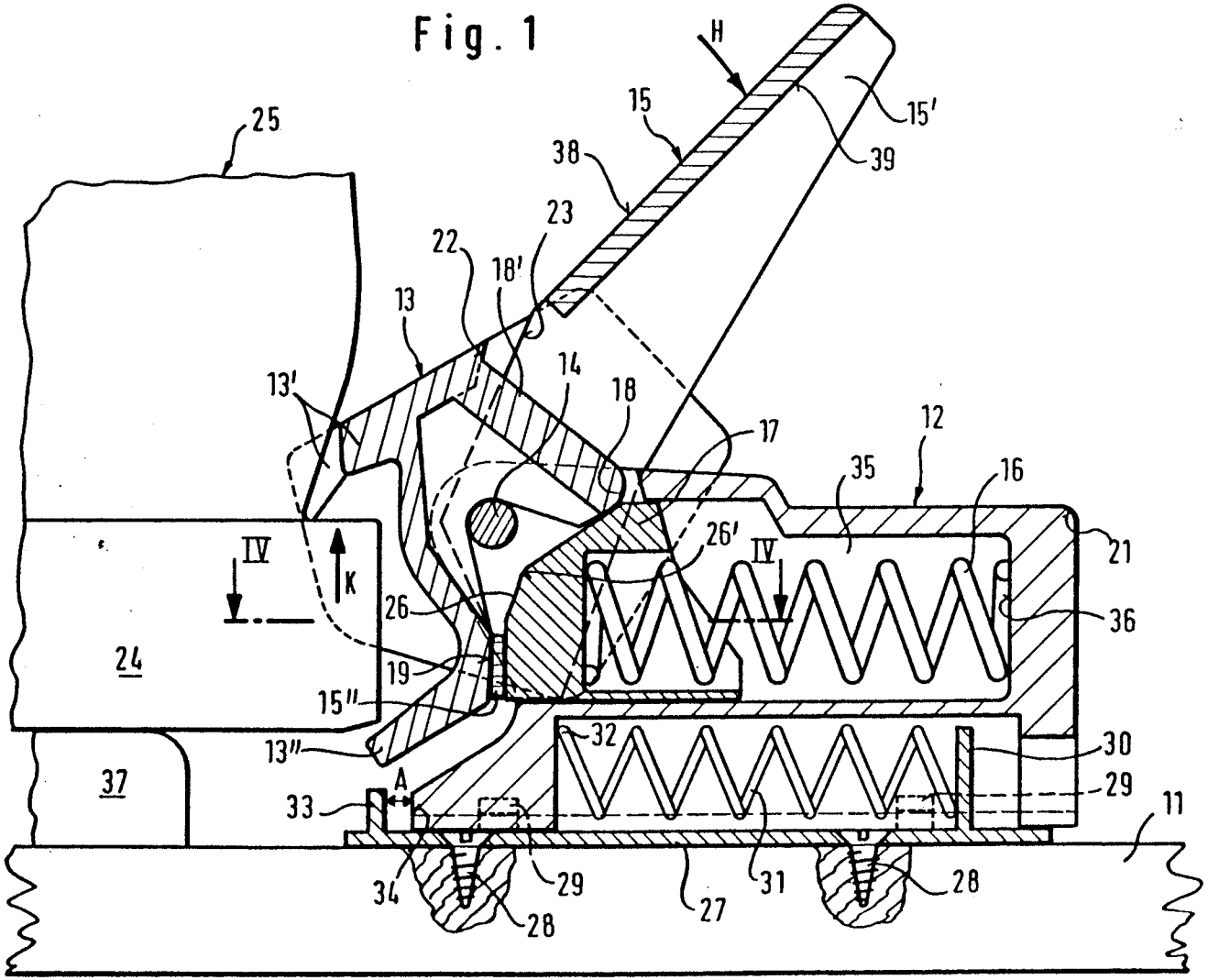

The invention relates to a heel unit of a ski binding comprising a housing which is preferably resiliently rearwardly deflectably mounted on the ski, wherein both a sole clamp having a hold-down member, and preferably also a pedal member, and also a hand-opening lever are pivotally mounted on the housing about a transverse axis in each case, wherein the sole clamp is normally biased into a closed position by a release spring via a transmission having a deadpoint, and wherein the sole clamp can snap into an open position through the deadpoint when excessive vertical forces are acting.

In the sense of the present invention a lever is to be understood under the term "hand-opening lever" which is not only actuated by hand but can also be actuated by means of a ski stick or with the ski boot or ski.

In the known heel unit or heel jaw of this kind (see for example German Offenlegungsschrift 38 26 410) the sole clamp and the hand-opening lever are arranged on different transverse axles in the housing in order to take account of the different requirements for the movements of these two components. Moreover, the transverse axle for the sole clamp is arranged at a relatively large spacing from the connection line between the hold-down member and the pedal element, which makes the freeing of the ski boot from the binding in the open position more difficult, since for constructional reasons the sole clamp can only be pivoted in a comparatively restricted angular range. This is particularly disadvantageous with heel units which are displaceable in the longitudinal direction of the ski against the force of a thrust spring and which cooperate with a pliers-like front unit because in this case the heel unit moves closer to the sole of the ski boot during the safety opening procedure.

A disadvantage of known heel units exists furthermore in the fact that on hand-opening of the hand-opening lever a comparatively long empty angular movement must be executed before an opening moment is exerted on the sole clamp. This delay in the opening of the sole clamp can admittedly be avoided by the provision of a special sole clamp opening spring, however, a further component in the form of the opening spring is necessary for this purpose.

The principle object underlying the invention is to provide a heel unit of the initially named kind which is of particularly simple and constructionally less costly construction but which nevertheless ensures a reliable opening of the sole clamp, and above all a wide angle of opening of the sole clamp, both during safety opening and during hand-opening.

In order to satisfy this object the present invention provides a heel unit on the initially named kind which is characterized in that the sole clamp and the hand-opening lever are pivotable about the same transverse axis which is arranged in the front region of the housing and have actuating abutments which cooperate with one another at a radial spacing from the transverse axis, with an opening moment being transmitted from the hand- opening lever to the sole clamp via the actuating abutments.

Through the provision of only a single transverse axle both for the sole clamp and also for the hand-opening lever the constructional complexity for the manufacture of the heel unit of the invention is considerably reduced. The uniting of the two transverse axes of the sole clamp and of the hand-opening lever also makes it possible to arrange the resulting transverse axis very close to the sole of the ski boot when the binding is closed, whereby a comparatively large angular pivotal path of the sole clamp is made possible which, on the one hand, ensures reliable separation of the hold-down member from the sole of the ski boot in the open state and, on the other hand, permits a relatively large angle of upward pivoting of the pedal element, whereby entry into the binding after an opening process is facilitated.

As a result of the common axis between the sole clamp and the hand-opening lever it is also possible for the actuating abutments of the sole clamp and the hand-opening lever to contact one another even when the binding is closed so that a pivoting of the sole clamp in the direction of the open position is brought about from the start of the pivotal movement of the hand-opening lever out of the closed position. Despite the lack of an opening spring the opening of the sole clamp is thus effected without delay on actuation of the hand-opening lever.

The hand-opening lever has an actuating arm which has at least a substantial component extending rearwardly from the transverse axis, with the actuating arm being pivotable from an upper position downwardly. As a result of this construction the hand-opening lever can be simply actuated by pressure from above, which can for example take place by hand, with the ski stick or by pressing with the other ski or ski boot. For this purpose the upper surface of the actuating arm can be of correspondingly large area construction.

In a constructionally particularly advantageous solution an abutment arm is provided on the hand-opening lever and extends away from the transverse axle essentially in the opposite direction to the actuating arm. In this way the actuating abutments are arranged in the vicinity of the pedal element at a position where they can be particularly favourably accomodated spacewise.

In a particularly preferred embodiment the hand-opening lever has an open position which is determined by an abutment fixed relative to the housing and the sole clamp, which is biased into the open position by the release spring after it has passed through the deadpoint, is braced via holding abutments against the hand-opening lever which is located in the open position. In this way the hand-opening lever can be pressed against the fixed housing abutment in the open position via the sole clamp which is biased by the release spring into the open position, so that a rattlefree transport of skis equipped with the heel units of the invention is possible in the open position, without a separate resetting spring having to be provided for the hand-opening lever.

A further advantageous embodiment is characterized in that when the actuating abutments are in contact, the holding abutments have a spacing such that during the transition from the closed position into the open position the sole clamp executes a clearly larger angular movement than the hand-opening lever. Here the sole clamp has a pivotal range which is larger than that of the hand-opening lever by 5° to 20°, in particular by 5° to 15° and preferably by an angle of the order of magnitude of 10°. The sole clamp 13 then has a pivotal range of 50° and in particular of 60° whereas the hand-opening lever has a pivotal range of 40° to 60° and in particular of approximately 50°. Thus the sole clamp has a substantially larger angular pivotal range than the brand-opening lever. The invention here makes use of the circumstance that the sole clamp, after passing through the deadpoint, is pivoted further into the position of opening by the release spring, so that the hand-opening lever is no longer required for this part of the opening movement of the sole clamp. Consequently the hand-opening lever can already abut against its fixed housing abutment shortly after the transmission has passed through the deadpoint, whereupon the sole clamp is then pivoted further into the fully open position by means of the opening spring. For this purpose, the sole clamp should be given a corresponding pivotal angular range, the preferred dimensions of which are set forth above.

The position of the common transverse axis is advantageously selected in such a way that it is located between the hold-down member and the pedal element and indeed preferably at a distance from 30 to 70%, in particular from 40 to 60% and especially of approximately 50% of the spacing of the hold-down member and the pedal element.

The spacing of the transverse axis from the connection line is preferably so small that when the binding is closed the rear edge of the sole of the ski boot is located at a small spacing from the transverse axle. Moreover, the spacing of the transverse axle from the connection line of the hold-down member and of the pedal element should amount to 40 to 70%, preferably 40 to 60%, and in particular to approximately 50% of the length of this connection line.

As a result of the relative close arrangement of the transverse axis relative to the sole of the ski boot in the closed state of the heel binding it is also ensured that the actuating hand-opening lever is several times longer in comparison to the abutment arm, whereby a lever ratio is obtained which considerably reduces the hand-opening force. Thus the actuating arm is preferably at least twice as long as the abutment arm is however preferably three to five times and most preferably approximately four times as long as the actuating arm.

In an advantageous embodiment the transmission of the heel unit of the invention is formed constructionally as a latch cam-cam track transmission. In such an embodiment the transmission comprises a latch cam which is preferably located on the sole clamp and a cam track with a deadpoint which is preferably provided on a slider which is displaceably journalled in the housing and moveable in the direction of the sole clamp.

In this arrangement the hand-opening lever is preferably fixed in the open position by the sole clamp and the sole clamp is movable solely by the ski boot sole, by the hand-opening lever and/or by the release spring. These embodiments give expression to the fact that it is particularly advantageous, in accordance with the invention, when neither the sole clamp nor the hand-opening lever have to be equipped with particular opening and/or resetting springs.

Finally, the actuating abutment surface of the abutment arm of the hand-opening lever is preferably located on a web which extends up to and in front of an abutment surface of the transmission part movable relative to the sole clamp, in particular of the slider, and which comes into contact with the abutment surface when the sole clamp is in the closed position as a result of the closing forces which are transmitted via the actuating abutments which are in contact. Through this embodiment rattling of the hand-opening lever is effectively avoided when the binding is closed because, even when the ski boot is not inserted, the release spring moves the moveable part of the transmission, in particular the slider, into the closed position until the web comes into abutment with the abutment surface as a result of the forces which are transmitted via the actuating abutments. Thus the hand-opening lever is resiliently held in a specific position when the binding is closed. This has the advantage that blows, which may for example act on the binding after a fall, or act on the hand-opening lever during skiing, can be damped by the release spring.

Figure 2:
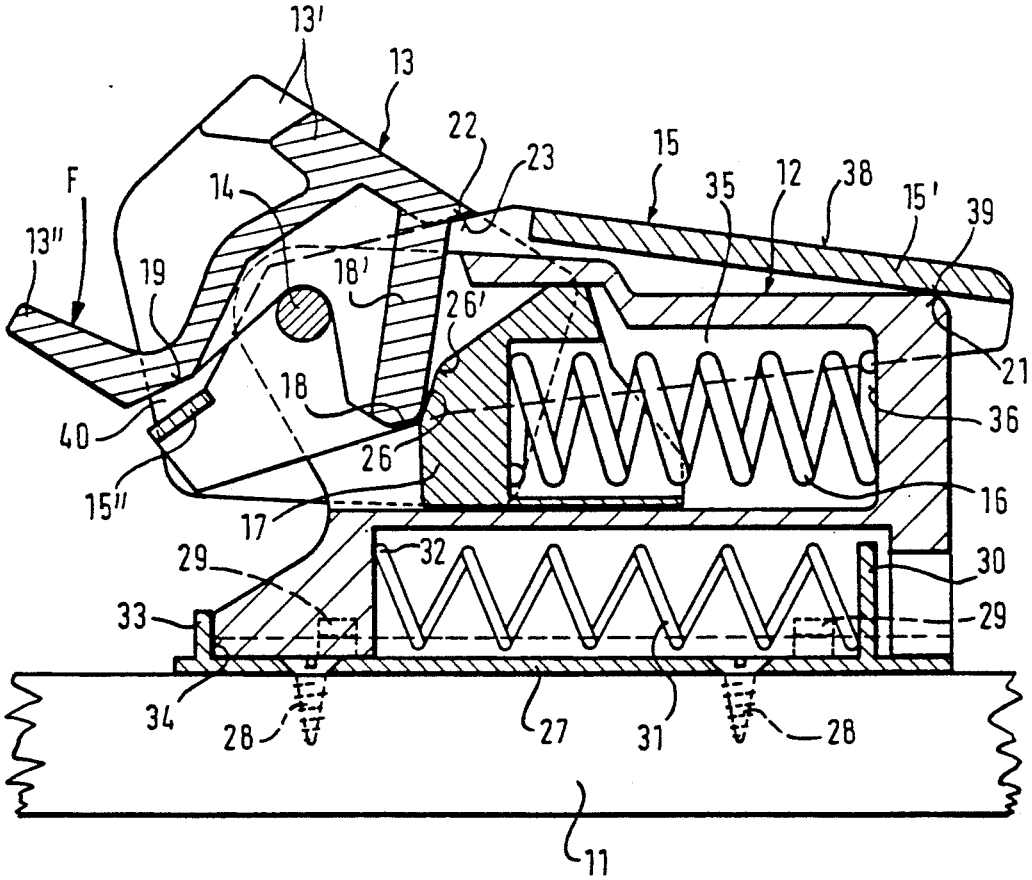
Figure 3:
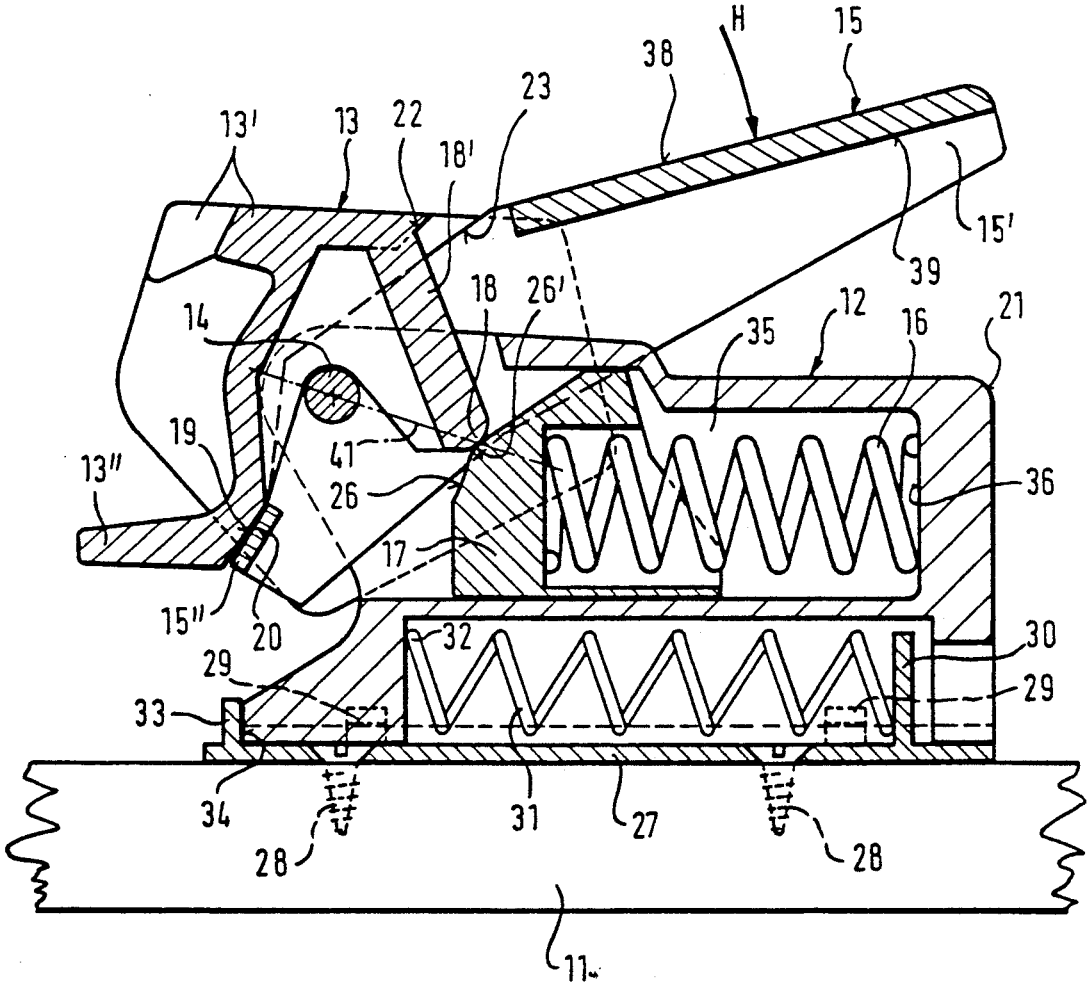
Figure 4:
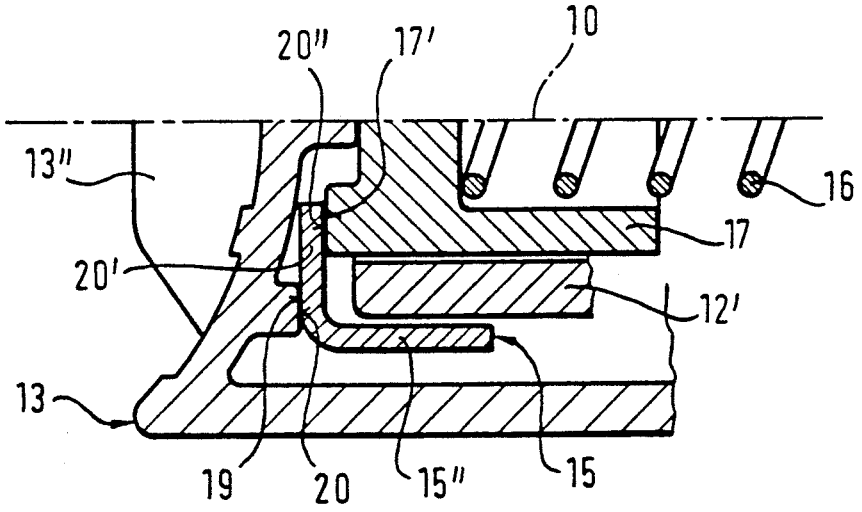

The invention will now be described in the following by way of example only and with reference to the drawings in which are shown:

FIG. 1 a partly sectioned schematic sideview of a heel unit in accordance with the invention in the closed position with the inserted ski boot, FIG. 2 the same heel unit in the open position, FIG. 3 the same heel unit during a hand-opening procedure shortly before attaining the deadpoint, and FIG. 4 a section on the line IV—IV in FIG. 1 with only the half of the unit which is located beneath the central longitudinal axis being shown in FIG. 4, while the non-illustrated other half is formed in mirror image fashion to the illustrated half.

As seen in FIG. 1 to 3 the base plate 27 of a heel unit in accordance with the invention is secured to a ski 11 by means of screws 28. A binding housing 12 is restrictedly displaceably arranged in the longitudinal direction of the ski on the base plate 27 by means of schematically illustrated slide guides 29. A thrust spring 31 which is braced at its rear end against an abutment 30 secured to the base plate 27 presses with its front end 32 against the binding housing 12 in such a way that when a ski boot is not inserted the binding housing is pressed against a front abutment 33 secured to the base plate 27. When the ski boot 25 is inserted in the closed heel unit (FIG. 1) the binding housing 12 is displaced rearwardly by the thrust path A (FIG. 1) while compressing the thrust spring 31, so that a corresponding spacing is present between the abutment 33 and the counter abutment 34 on the binding housing.

The components which determine the thrust path A are only schematically illustrated in the drawing. The measures which are generally provided for the adjustment of the thrust path and/or of the thrust force are not shown in detail.

The binding housing 12 has a space 35 for accomodating the release spring 16 which extends essentially in the longitudinal direction of the ski 11. In general the bias force of the release spring can be changed by an adjustment screw, which is not shown in the drawing for the sake of a simplified representation.

Whereas the rear end of the release spring 16 is braced against an abutment 36 of the binding housing 12, the front end acts on a slider 17 which is displaceably arranged in the longitudinal direction of the ski in the hollow cavity 35. The slider 17 carries at its front end a cam track 26 which starts at the bottom with a comparatively steep region and then merges via a deadpoint 26' into a flatter region.

The cam track 26 is pressed by the release spring 16 against a latch cam 18 which is formed on a latch cam arm 18' of a sole clamp or holder 13 which is pivotally journalled about a transverse axle 14 in the front region of the binding housing 12. The sole clamp 13 is provided at its front end with a hold-down element 13' which, in the closed position of the binding (FIG. 1), presses the ski boot sole 24 from above against a foot plate 37 arranged on the ski 11.

In the lower region the sole clamp has a pedal element 13'' onto which the sole 24 of the ski boot can be placed in the open position of the heel unit (FIG. 2) in order to exert a closing force on the sole clamp 13.

A hand-opening lever 15 is pivotally journalled about the same transverse axle 14 as the sole clamp 13 and has an actuating arm 15' which extends essentially in the longitudinal direction of the ski in the open position of FIG. 2 and an abutment arm 15'' which extends in this position obliquely forwardly and downwardly from the transverse axis 14. The actuating arm 15' is approximately four times as long as the abutment arm 15''.

Whereas the actuating arm 15' is equipped with an actuating surface 38 which is as large as possible the substantially shorter abutment arm 15'' is provided at its lower front region with an actuating abutment 20 which cooperates with an oppositely disposed actuating abutment 19 of the sole clamp 13 which is located directly behind the pedal element 13''.

At its rear region the actuating arm 15' is provided with a lower abutment surface 39 which cooperates with an upper abutment 21 on the binding housing 12 in such a way that the essentially horizontal opened position of the actuating arm 15' is determined by contact of the abutment surface 39 against the abutment 21.

The sole clamp 13 has a holding abutment 22 behind the hold-down member 13' and this holding abutment 22 contacts in the open position of the sole clamp 13 (FIG. 2) against the oppositely disposed holding abutment 23 of the actuating arm 15' of the hand-opening lever 15.

The manner of operation described herein is as follows:

In the opened position of FIG. 2 the release spring 16 presses the sole clamp 13 into the open position via the lower steep part of the cam track 26 and the latch cam 18, with the pivotal movement of the sole clamp 13 (in the clockwise sense in FIG. 2) being restricted by the mutual contact of the abutments 22, 23 and 21, 39.

In this state the binding can be transported in rattle-free manner. The reliable contact of the abutments 22, 23 and 21, 39 is ensured solely by the bias of the release spring 16.

Starting from the opened position of FIG. 2 the sole 24 of the ski boot 25 (FIG. 1) can be placed in the direction of the arrow F onto the pedal element 13'' whereupon, under the action of the force exerted via the sole 24 of the ski boot, the sole clamp 13 is pivoted in the counterclockwise direction while compressing the release spring 16 until the latch cam 18 has reached the deadpoint 26' of the cam track 26. From this instant onwards the release spring 16 can relax again during further pivotal movement of the sole clamp 13 in the counterclockwise sense so that the sole clamp 13 now snaps into the closed position which is evident from FIG. 1 in which the hold-down member 13' presses the sole 24 of the ski boot against the foot plate 37.

During the downward pivotal movement of the sole clamp 13 the actuating abutment 19 of the sole clamp 13 comes into engagement, after an angular path determined by the size of a gap 40 (FIG. 2), with the actuating abutment 20 of the abutment arm 15'' of the hand-opening lever 15, whereby the holding abutments 22, 23 move apart from one another accordingly. The hand-opening lever 15 is now likewise pivoted in the counterclockwise sense into the position of FIG. 1. This pivotal movement of the hand-opening lever 15 can be so restricted by a non-illustrated abutment that the hand-opening lever 15 is pressed via the holding abutments 22, 23 against the relevant abutment as soon as the hold-down member 13' presses the sole 24 of the ski boot against the foot plate 37. A special resetting spring for the hand-opening lever is thus not required.

The safety release proceeds in such a way that with a predetermined upwardly directed force K (FIG. 1) acting on the sole 24 of the ski boot the sole clamp 13 is pivoted upwardly while compressing the release spring 16 until, after exceeding the deadpoint 26', the sole clamp of itself snaps into the open position in FIG. 2.

With arbitrary opening by hand, by means of the ski stick, or by means of the other ski boot or ski, pressure can be exerted in the direction of the arrow H (FIGS. 1, 3) from above onto the actuating arm, whereupon the hand-opening lever 15 is pivoted in the clockwise sense and takes the sole clamp 13 with it by means of the actuating abutments 19, 20. The shape and force-locked connection between the hand-opening lever 15 and the sole clamp 13 is maintained up to the instant at which the latch cam 18 reaches the deadpoint 26' starting from the flat part of the cam track 26 (FIG. 3). As soon as the latch cam 18 has exceeded the deadpoint 26' and reached the steeper part of the cam track 26 the torque exerted by the release spring 16 on the sole clamp 13 via the slider 17 changes to an opening moment, so that the sole clamp 13 now snaps into the opened position under the action of the force of the release spring 16 and in doing so moves the hand-opening lever 15 which may as necessary still be acted on by the opening force H, into the opened position which can be seen in FIG. 2.

The latch cam 18 and the cam track 26 are so arranged, in accordance with FIG. 3, that the lever arm 18' defined by the latch cam lays, on exceeding the deadpoint 26', on the connection line 41 between the transverse axle 14 and the deadpoint 26', so that in this position unstable equilibrium is present between a closing moment and an opening moment.

FIG. 4 shows on the one hand that the slider 17 was guided by lateral guide webs 12'. The two side limbs of the abutment arm 15'' of the hand-opening lever 15' extend alongside the webs 12' which are provided on both sides of the slider 17 and are bent inwardly at right angle of the front end to form a flat web 20' in order to form, on the one hand, an actuating abutment 20 for the actuating abutment 19 of the sole clamp 13 and, on the other hand, to form an abutment surface 20'' provided at the opposite side for a front abutment surface 17' of the slider 17, with the surfaces 17', 20'' coming into force transmitting engagement when the binding is closed.

In the closed position of the binding of FIG. 1 a closing moment is transmitted by the release spring 16 via the cam track 26 and the latch cam 18 onto the sole clamp 13, and indeed until the actuating abutments 19, 20 have first entered into engagement and until, in the further course of the closing movement, the surfaces 17', 20' have also come into engagement in accordance with FIG. 4, with the slider advanced and the abutment arm 15'' displaced rearwardly. From this moment on a further movement of the slider 17 in the forward direction is precluded. However, with a blow on the binding, for example in the case of the fall, the web 20' or the abutment arm 15'' can deflect resiliently rearwardly with a certain rearward sliding of the slider 17.

Through this measure rattlefree transport can also be ensured when the binding is closed.

With the boot inserted the hand-opening lever 15 is resiliently held in a specific position when the binding is closed, even when the sole hold-down member 13' only touches the sole 24 of the ski from above but does not exert any downwardly directed clamping force.

The particularly advantageous arrangement of the abutment arm 15'' of FIG. 4 thus has the advantage that blows which may for example act after a fall on the binding, or during skiing on the hand-opening lever, are damped by the slider 17 and the release spring 16.

We claim:

1. A heel unit for a ski binding adapted to be mounted on a ski comprising:

a housing having a forward portion and a rear portion;

a sole clamp mounted to the forward portion of the housing for pivotal movements about a transverse axis and having a ski boot hold-down member and a release pedal;

a hand-opening lever mounted to the housing for pivotal movements about said transverse axis and extending in a rear direction therefrom;

force transmission means operatively coupled with the housing and the sole clamp for generating a holding force which releasably retains the sole clamp in a closed position or in an open position while permitting movement of the sole clamp between the positions when a moment of sufficient magnitude is applied to the sole clamp; and an abutment arm fixed to the hand-opening lever including an actuating abutment surface which is radially spaced from said transverse axis and which extends from said axis in a direction generally opposite to the hand-opening lever;

the sole clamp including an engagement surface positioned opposite the abutment surface so that the application of a downwardly acting force to the hand-opening lever pivots the lever and therewith the abutment surface against the engagement surface and thereby generates a moment for moving the sole clamp in opposition to the holding force from its closed position towards its open position.

2. A heel unit for a ski binding as claimed in claim 1 wherein the distance between the center of the transverse axis and an imaginary line connecting the release pedal and the ski boot hold-down member, defined by a line perpendicular to the imaginary line, is such that when the sole clamp is in the closed position, a rear of a ski boot in the binding is located proximate to the transverse axis.

3. A heel unit for a ski binding as claimed in claim 1 wherein said force transmission means includes a spring-biased slider moveable relative to the housing defining a sole clamp hold-down surface, a sole clamp release surface, and a deadpoint therebetween, the slider engaging the sole clamp with one of the surfaces and correspondingly biasing it into its closed or its open position.

4. A heel unit for a ski binding as claimed in claim 3 wherein the slider further includes a latch cam member which engages one of the surfaces defined by the slider to bias said sole clamp into its closed or its open position.

5. A heel unit for a ski as claimed in claim 3 wherein the transmission slider includes an abutment surface which abuts against another abutment surface on the actuating arm of the hand-opening lever, said abutment surface of the actuating arm forming a web that extends upwardly to contact the abutment surface of the slider in the closed position of the sole clamp.

6. A heel unit for a ski binding as claimed in claim 1 wherein the sole clamp and the hand-opening lever further define holding abutment surfaces for bracing the sole clamp against the hand-opening lever in the open position of the sole clamp.

7. A heel unit for a ski binding adapted to be mounted on a ski comprising:

a housing having a forward portion and a rear portion;

a hand-opening lever mounted to the housing for pivotal movements about a transverse axis located at the forward portion of the housing, the lever extending from the axis in a rearward direction and including a stop surface arranged to engage the housing and limit relative pivotal movements of the lever in a first, release direction from its locking position to its release position;

a sole clamp mounted to the housing for pivotal movements about said transverse axis and having a ski boot hold-down member and a release pedal;

force transmission means operatively coupled with the housing and the sole clamp including a spring-biased slider moveable relative to the housing defining a sole clamp hold-down surface, a sole clamp release surface and a deadpoint there between, the slider engaging the sole clamp with one of the surfaces and biasing it into its closed or its open position;

an actuating abutment surface on the sole clamp cooperating with a first actuating abutment surface on an actuating arm of the hand-opening lever for transmitting pivotal movements of the lever in the first, release direction to the sole clamp for moving the sole clamp from its closed position towards its open position, the slider including an abutment surface which abuts against a second actuating abutment surface on said actuating arm of the hand-opening lever, said first and second actuating abutment surfaces of the actuating arm together forming a web that extends upwardly to contact the abutment surface of the slider in the closed position of the sole clamp; and holding abutment surfaces defined by the sole clamp and the hand-opening lever for bracing the sole clamp against the hand-opening lever, the holding abutment surfaces being arranged relative to each other such that when the sole clamp pivots from its closed position into its open position, it pivots through an angle larger than the angle through which the hand-opening lever pivots between its locking position and its release position.

* * * * *